US005768713A

United States Patent [19]

Crick

[11] Patent Number: 5,768,713

[45] Date of Patent: Jun. 23, 1998

[54] HOSIERY ARTICLE WITH MOISTURE ABSORBING PADS

[76] Inventor: Elsa Crick, 237 E. 91st St., Brooklyn, N.Y. 11212

[21] Appl. No.: 804,390

[22] Filed: Feb. 21, 1997

[51] Int. Cl.[6] ..... A41B 11/04

[52] U.S. Cl. ..... 2/409; 2/239

[58] Field of Search ..... 2/409, 239

[56] References Cited

U.S. PATENT DOCUMENTS 1,162,820 12/1915 Taylor ..... 2/239

3,212,103 10/1965 Goodman ..... 2/409

3,909,851 10/1975 Garrou et al. ..... 2/409

FOREIGN PATENT DOCUMENTS 3329121 2/1985 Germany ..... 2/239

190240 12/1922 United Kingdom ..... 2/239

*Primary Examiner*—Gloria M. Hale

[57] ABSTRACT

A hosiery article with moisture absorbing pads including a pair of panty hose. A pair of cotton foot pads are dimensioned for securement to an interior lower surface of a pair of foot portions of the pair of panty hose. The foot pads are disposed under the wearer's feet when wearing the pair of panty hose to absorb perspiration.

1 Claim, 2 Drawing Sheets

3
4
18
14
4
12
16
30
26
28

10
14
2
26
2

16

HOSIERY ARTICLE WITH MOISTURE ABSORBING PADS

BACKGROUND OF THE INVENTION

1. Field of the Invention

The present invention relates to a hosiery article with moisture absorbing pads and more particularly pertains to absorbing perspiration from a wearer's feet with a hosiery article with moisture absorbing pads.

2. Description of the Prior Art

The use of reinforced hosiery is known in the prior art. More specifically, reinforced hosiery heretofore devised and utilized for the purpose of reinforcing foot areas of hosiery are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,341,097 to Cassidy, Sr. et al. discloses a hosiery article with a reinforced toe portion of varying density.

U.S. Pat. No. 4,037,436 to Wehrmann discloses a toe construction and method for seamless hosiery products having an arch shaped toe reinforcement portion.

U.S. Pat. No. 4,263,727 to Bender et al. discloses a sheet of cushioned insole material comprising a substrate and a foamed plastic layer.

U.S. Pat. No. 4,106,126 to Tranekle discloses a within-the-shoe sock having removable retaining device.

U.S. Pat. No. 4,903,345 to Oakley discloses stockings with connecting crotchpiece.

U.S. Pat. No. Des. 274,361 to Whitehead discloses the ornamental design for a thin absorbent pad for a panty liner or the like.

While these devices fulfill their respective, particular objective and requirements, the aforementioned patents do not describe a hosiery article with moisture absorbing pads for absorbing perspiration from a wearer's feet.

In this respect, the hosiery article with moisture absorbing pads according to the present invention substantially departs from the conventional concepts and designs of the prior art, and in doing so provides an apparatus primarily developed for the purpose of absorbing perspiration from a wearer's feet.

Therefore, it can be appreciated that there exists a continuing need for new and improved hosiery article with moisture absorbing pads which can be used for absorbing perspiration from a wearer's feet. In this regard, the present invention substantially fulfills this need.

SUMMARY OF THE INVENTION

In the view of the foregoing disadvantages inherent in the known types of reinforced hosiery now present in the prior art, the present invention provides an improved hosiery article with moisture absorbing pads. As such, the general purpose of the present invention, which will be described subsequently in greater detail, is to provide a new and improved hosiery article with moisture absorbing pads and method which has all the advantages of the prior art and none of the disadvantages.

To attain this, the present invention essentially comprises a pair of panty hose fabricated of a nylon material. The pair of panty hose include a pair of leg portions, a pair of foot portions extending from lower ends of the leg portions, a waist portion, and a crotch portion. The waist portion has an elastic band secured therein for retention of the pair of panty hose to a wearer. The device includes a pair of cotton foot pads. The cotton foot pads are dimensioned for securement to an interior lower surface of the pair of foot portions of the pair of panty hose. The foot pads are disposed under the wearer's feet when wearing the pair of panty hose. The foot pads have a front end extending to a point on a toe portion of the foot portions above a wearer's toes. The foot pads have a back end extending to a point on a heel portion of the foot portions above a wearer's heel. A cotton crotch pad is dimensioned for securement to an interior surface of the crotch portion of the panty hose.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis a for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hosiery article with moisture absorbing pads which has all the advantages of the prior art reinforced hosiery and none of the disadvantages.

It is another object of the present invention to provide a new and improved hosiery article with moisture absorbing pads which may be easily and efficiently manufactured and marketed.

It is a further object of the present invention to provide a new and improved hosiery article with moisture absorbing pads which is of durable and reliable construction.

An even further object of the present invention is to provide a new and improved hosiery article with moisture absorbing pads which is susceptible of a low cost of manufacture with regard to both materials and labor, and which accordingly is then susceptible of low prices of sale to the consuming public, thereby making such a hosiery article with moisture absorbing pads economically available to the buying public.

Still yet another object of the present invention is to provide a new and improved hosiery article with moisture absorbing pads which provides in the apparatuses and methods of the prior art some of the advantages thereof, while simultaneously overcoming some of the disadvantages normally associated therewith.

Even still another object of the present invention is to provide a new and improved hosiery article with moisture absorbing pads for absorbing perspiration from a wearer's feet.

Lastly, it is an object of the present invention to provide a new and improved hosiery article with moisture absorbing pads including a pair of panty hose. A pair of cotton foot pads are dimensioned for securement to an interior lower surface of a pair of foot portions of the pair of panty hose. The foot pads are disposed under the wearer's feet when wearing the pair of panty hose to absorb perspiration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

With reference now to the drawings, and in particular, to FIGS. 1–4 thereof, the preferred embodiment of the new and improved hosiery article with moisture absorbing pads embodying the principles and concepts of the present invention and generally designated by the reference number 10 will be described.

Specifically, it will be noted in the various Figures that the device relates to a hosiery article with moisture absorbing pads for absorbing perspiration from a wearer's feet. In its broadest context, the device consists of a pair of panty hose, a pair of cotton foot pads and a cotton crotch pad. Such components are individually configured and correlated with respect to each other so as to attain the desired objective.

Figures 1, 2:
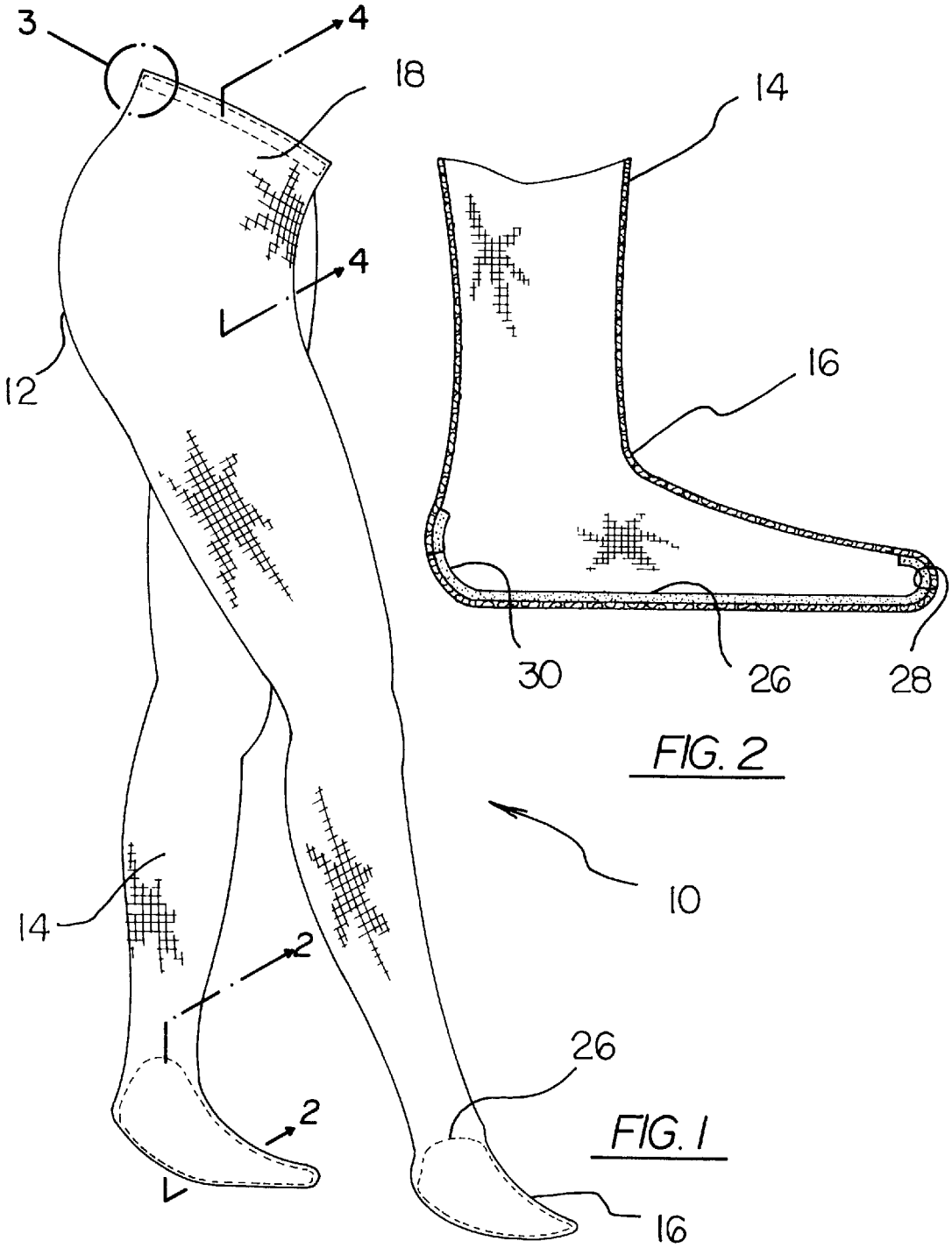
FIG. 1 is a perspective view of the preferred embodiment of the hosiery article with moisture absorbing pads constructed in accordance with the principles of the present invention.
FIG. 2 is a cross-sectional view as taken along line 2—2 of FIG. 1.
Figure 3:
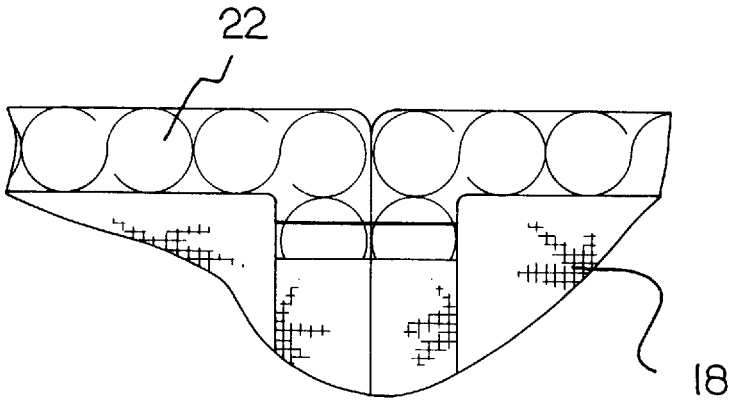
FIG. 3 is a enlarged sectional view taken along circle 3 of FIG. 1.
Figure 4:
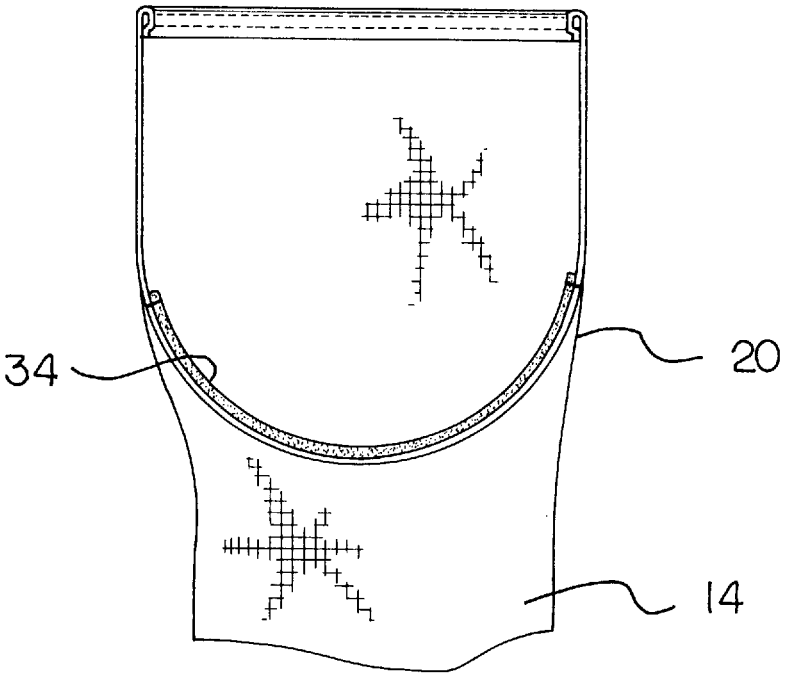
FIG. 4 is a cross-sectional view as taken along line 4—4 of FIG. 1.

The device 10 includes a pair of panty hose 12 fabricated of a nylon material. The pair of panty hose 12 include a pair of leg portions 14, a pair of foot portions 16 extending from lower ends of the leg portions 14, a waist portion 18, and a crotch portion 20. The waist portion 18 has an elastic band 22 secured therein for retention of the pair of panty hose 12 to a wearer. The pair of panty hose 12 are of the type known in the prior art. FIG. 1 shows the pair of panty hose 12 in detail.

The device 10 also includes a pair of cotton foot pads 26. The cotton foot pads 26 are dimensioned for securement to an interior lower surface of the pair of foot portions 16 of the pair of panty hose 12. The foot pads 26 are disposed under the wearer's feet when wearing the pair of panty hose 12. The foot pads 26 have a front end 28 extending to a point on a toe portion of the foot portions 16 above a wearer's toes. The foot pads 26 have a back end 30 extending to a point on a heel portion of the foot portions 28 above a wearer's heel. The foot pads 26 are fabricated of a soft, absorbent cotton or other similar material to form a sole of the device 10. The cotton breathes, and more effectively absorbs perspiration than nylon does. The type of material used would be like the material used to make socks. This combination would provide a line of hosiery that would be more comfortable and healthy to wear.

A cotton crotch pad 34 is dimensioned for securement to an interior surface of the crotch portion 20 of the panty hose 12. The crotch pad 20 would provide added comfort to the woman wearing the pair of panty hose 12.

The present invention could be worn by any woman who suffers from excessive foot perspiration and the attendant problems of foot odor or from foot ailments like athlete's foot. It could be especially useful to women employed in white collar jobs because they often forfeit the comfort of white socks by wearing pantyhose to work.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hosiery article with moisture absorbing pads for absorbing perspiration from a wearer's feet comprising, in combination:

a pair of panty hose fabricated of a nylon material, the pair of panty hose including a pair of leg portions, a pair of foot portions extending from lower ends of the leg portions, a waist portion, and a crotch portion, the waist portion having an elastic band secured therein for retention of the pair of panty hose to a wearer;

a pair of cotton foot pads, the cotton foot pads dimensioned for securement to an interior lower surface of the pair of foot portions of the pair of panty hose, the foot pads being disposed under the wearer's feet when wearing the pair of panty hose, the foot pads having a front end extending to a point on a toe portion of the foot portions above a wearer's toes, the foot pads having a back end extending to a point on a heel portion of the foot portions above a wearer's heel, wherein the foot pads are fabricated of a soft, absorbent cotton; and a cotton crotch pad dimensioned for securement to an interior surface of the crotch portion of the panty hose.

* * * * *